United States Patent [19]

Csillag et al.

[11] Patent Number: 4,807,815

[45] Date of Patent: Feb. 28, 1989

[54] AIR-JET MILL AND ASSOCIATED PREGRINDING APPARATUS FOR COMMINUATING SOLID MATERIALS

[75] Inventors: Zsolt Csillag; Géza Szentgyörgyi; Károly Solymár; Tibbr Kálmán; Pál Tóth; Ferenc Rosemann; János Steiner, all of Budapest; János Morzál, Érd; László Zsémberi, Budapest; Béla Lajtai, Diósd; Tibor Legát, Budapest; Ferenc Sitkei, Ajka; Ferenc Valló, Ajka; Bálint Szabó, Ajka; Gábor Molnár, Ajka; Sándor Czafit, Ajka, all of Hungary

[73] Assignee: Magyar Aluminiumipari Troszt, Hungary

[21] Appl. No.: 2,695

[22] PCT Filed: Apr. 3, 1986

[86] PCT No.: PCT/HU86/00020

§ 371 Date: Jan. 29, 1987

§ 102(e) Date: Jan. 29, 1987

[87] PCT Pub. No.: WO86/05717

PCT Pub. Date: Oct. 9, 1986

[30] Foreign Application Priority Data

Apr. 3, 1985 [HU] Hungary ..... 1272/85

[51] Int. Cl.[4] ..... B02C 19/06

[52] U.S. Cl. ..... 241/39; 241/152 R; 241/300

[58] Field of Search ..... 241/DIG. 37, 65, 5, 241/39, 40, 80, 97, 152 R, 300

[56] References Cited

U.S. PATENT DOCUMENTS

| | | | |
|---|---|---|---|
| 3,559,895 | 2/1971 | Fay | 241/5 |
| 4,504,017 | 3/1985 | Andrews | 241/152 R X |

FOREIGN PATENT DOCUMENTS

| | | |
|---|---|---|
| 2523471 | 3/1983 | Fed. Rep. of Germany . |
| 3201778 | 10/1983 | Fed. Rep. of Germany . |
| 3140294 | 11/1983 | Fed. Rep. of Germany . |
| 2543691 | 1/1984 | Fed. Rep. of Germany . |

*Primary Examiner*—Mark Rosenbaum
*Attorney, Agent, or Firm*—Handal & Morofsky

[57] ABSTRACT

An air-jet mill provided with pregrinding chambers and inner sizer suitable for fine grinding (below 10 μ), for cryogenic grinding and also for surface treatment during grinding of hard, elastic and/or thermoplastic materials.

During operation there are no moving components to be exposed to heavy wear, and an inner sizer, forming an integral part of the grinding space, uses the energy left after grinding in the system to enable a sharp sizing or separation of fine fractions.

21 Claims, 4 Drawing Sheets

AIR-JET MILL AND ASSOCIATED PREGRINDING APPARATUS FOR COMMINUATING SOLID MATERIALS

FIELD BACKGROUND OF THE INVENTION

The object of the invention is an energy-saving internal sizing air-jet mill having a pregrinding chamber for fine grinding of preferably various carbides, silicates, oxides, ores, pigments or elastic materials, as well as for surface treatment and/or cryogenic grinding of the same.

The air-jet mills known according to the present state of art, could be divided into five basic types. The first type is characteristic of the situation where grinding comes about by accelerating the material to high speed through a nozzle and impacting it against a so-called anvil. This apparatus provides adequate grinding; however, due to high specific energy consumption its operation is not economical and the lining experiences much wear thereby causing high contamination of the ground product.

In order to eliminate such contaminating effect, it is often the practice to use linings from the same basic material as the material which is to be ground. The best known version of this type now in use is the air-jet mill of the Vortex system provided with an outer sizer or separator, ceramic lining and anvil. The other type of the air-jet mill widely used is the so-called Majec mill. Here, comminution takes place by the autogenous grinding effect of grains impacting against each other by the acceleration generated through two nozzles facing one another. This operation, however, exhibits energy losses and thus very poor comminution efficiency. The nozzles can carry comparatively small amounts of grains and vortices occur also due to the effect of the opposite air jets thus fairly reducing the number of collision of grains. Known examples of this type are: West German Patents DE No. 2543691 C2 and DE No. 2523471 C2.

The third air-jet mill, the so called Micronizer type is the one which has been used most predominantly. The essence of its operation is that grinding takes place in the discusshaped grinding chamber under the effect of pressurized gas issuing from peripheral jet pipes. The gas jets first contact a circle in the outer third part or half of the grinding area. Material to be ground enters the grinding space in a vertical plane crossing the tangent of this circle, however, at an angle of 60° to the vertical passing through the top of the grinding space.

According to the theory of the designers, the grains greater in size than a predetermined dimension are circulating along this tangential circle, the smaller grains, that is, the ground end product discharge from the facility past obstructing dam entrained in the exhaust and, the coarser grains, under the effect of the pressurized gas from the peripheral nozzles, collide with each other and circulates until their dimensions are reduced to or below the required level. Under actual working conditions the operation of the facility does not meet the conditions of the above theoretical operation, yet the type is widely used as the unit presenting the best efficiency. Several patented inventions exist on the above apparatus, e.g. U.S. Pat. No. 3,726,484, SF-33960, DE No. 3201778 C1. These technical solutions represent the combination of the double-jet mill, the anvil type and the micronizer, where the coarse product is returned to the grinding space, or by applying a anvil-type pregrinder an attempt is made, with little success, to improve the fineness of grinding. Therefore, up to now, the unchanged basic type provided with some kind of liner is most frequently used in the industry.

With the fourth type of the air-jet mills, the goal was the increase of mill output by a method which did not cause the shortening of the path of free movement of particles.

In favour of this, the volume of grinding space and the number of nozzles has been increased, increasing thereby the output of mill relative to its unit volume, however, the efficiency of energy utilization has been decreased and the extent of wear also increased. This type of mill is known as the Jet-O-Mixer or Reductionizer. Addressed to the reduction of wear, the design of the Double-Impact-Mill appeared on the market. In the return branch of the upper part of the mill a so-called directional-change-sizer and further grinding nozzles have been applied in some cases. The achievement of a grain size of 1 μm by the use of these types of mills was not realized.

Fluid bed air-jet-mills may be included in the fifth type (e.g. DE No. 3140294 C2) where frequency of collision of particles and thus the efficiency of grinding is increased by the use of four nozzles of larger diameter, when compared to the previously mentioned methods, and which are operated opposite to each other and are located in the bottom part of a large container. The nozzles operate to fluidize the entire amount of material in the container with air flow entraining the finer grains to be passed through a rotating sizer in the top section of the container. Meanwhile, the coarser fraction slips back down the wall of the container for repeated grinding.

The above device possesses reasonably good grinding and sizing efficiency, however, it is not suitable for fine (below 10 μ) grinding, partly because, due to the short path length of the particles (high density), the resultant impact energy of the particles is small, partly because even the speed of rotation of the revolving part of the sizer, controlling the fineness of the end product, cannot be increased beyond a certain limit. Other disadvantages of this design lie in the condition that the revolving part of the sizer is exposed to high wear and, due to the high pressure in the grinding space, charging of the material can only be carried out by the use of an involved sluice system. Based on the knowledge obtained from the aforementioned types of mills, it can be established that the efficiency of air-jet facilities is favourable only if the particles possess high energy and the probability of impacting is also high, however, as the free path length required for particles to become accelerated shortens, the impact energy also diminishes, therefore, there is a compromise forming the basic problem in the operation of air-jet facilities: either to increase the free path length and make the ground product finer along with diminishing efficiency of the mill, or to increase the number of impacts which while resulting in a coarser product, improves the grinding efficiency and performance of the mill.

OBJECTS AND SUMMARY OF THE INVENTION

The invention is drawn towards the development of an air-jet mill structure capable of fine grinding very hard, elastic and/or thermoplastic materials to below 10 μm, which is energy-saving, and does not contain any moving parts, thus exhibiting high resistance to abrasion. It features an inner sizer as an integrated part of the mill. The sizing control is sharp and the unit does not consume a major portion of the comminution energy.

The invention is based on the recognition of the following:

grinding efficiency can considerably be improved by the adoption of pregrinding, by adequately increasing the number and appropriately arranging the feed nozzles, by the recirculation of coarser fractions into the pregrinding chamber, by selecting the appropriate number and arrangement of peripheral grinding nozzles the grinding work can be performed equally by all the nozzles, by eliminating moving parts, and supplying the material to be ground in a horizontal plane in a tangential direction, a minimum of abrasion wear can be achieved, and this wear can be confined to the easily replaceable elements of the pregrinding chamber, considerable diminution of wear of the pregrinding chamber can be attained by the use of as many auxiliary nozzles as the confluently jetting main nozzles and which are aimed at diverting the material from the wall, by the development of a new profile lining element, and by the adoption of a curb of blades of adjustable blade angle, a very sharp inner or internal sizing can be obtained (within the grain limits of 0.1–100 $\mu$) without any input of energy, just by the utilization of energy left after grinding, by appropriate axial adjustment of the nozzles, vacuum is generated in the charging orifice, enabling the charging and refeeding of materials to be ground as well as surface treating materials and/or coolants. This enables the apparatus to be suitable for surface treatment and also of grinding heat-sensitive elastic materials, setting of the angle of the peripheral nozzles in the grinding space (diverting the material from the wall) reduces the number of impacts on the wall, thus enabling an optimum adjustment of the movement of the material.

With the construction of the air-jet mill, according to the present invention, material feed takes place in the horizontal plane of the grinding space in tangential directional, thus besides good grinding efficiency, wear of the grinding space, occurring with the micronizer types, can be reduced. The use of a pregrinding chamber, resulting in a smaller diameter feed material, considerably improves the efficiency of grinding. The number and positioning of peripheral nozzles should be selected so as to allow each nozzle to perform an equal amount of grinding work. It is expedient to charge material into the grinding space after every second nozzle.

For instance, if six peripheral nozzles are applied and three tangentially set jet pipes are used, the grinding performance can be increased three-fold according tests made.

In order to further improve the grinding efficiency, the coarser fraction from the grinding space is returned to the pregrinding space through a channel by the effect of vacuum generated in the charging channel (i.e. aspiration). The material charging nozzles (injecting channels) are connected with the pregrinding chamber, the latter being provided with wear resistant lining, where two or more nozzles set at 90°–180° angles to each other and/or shifted also in the plane, are injecting the material confluently. In the case of running more than two confluent nozzles, two are performing material feed, the remaining ones, however, are decreasing wear by reducing the probability of particles impacting against the wall of the chamber.

The arrangement of nozzles, according to the invention, by giving rise to generation of vortices, i.e. by increasing the number of impacts of particles, results in very good grinding effect in the pregrinding chamber. The injecting nozzles are suitable also for introducing surface treating materials and/or a coolant into the system corresponding to the particular grinding technology required. Through proper adjustment, vacuum would be generated in the feed orifice causing the coolant or preground material to be aspirated into the grinding space. This is made possible by an injection nozzle coaxial with the injecting pipe exhibiting the highest pressure in the system and suitable for accelerating the preground material to an adequate velocity (the multiple of sound velocity) in spite of the vortices generated by the confluent nozzles.

Upon investigating the relation between comminution efficiency and pressure, it has been established that efficiency improves slightly up to 9 bar pressure, then rapid increase was experienced in the 9–5 bar range and finally severe agglomeration takes place in the range 15–25 bar pressure, depending on the material, deteriorating the efficiency of comminution.

With one potential alternative design of the air-jet mill according to the invention, there are four nozzles connected to the pregrinding chamber in tangential direction. The flow proceeds perpendicular to the main grinding space and the gas jets are generating the vortex by contacting a circle of comparatively small radius. With this solution, two nearly horizontal nozzles are shooting together the material to be ground, the other two nearly vertical nozzles, however, are conducting gas or air to the system. The latter may be linked to the containers of reagents or coolant. The injecting tubes are connected tangentially at three points to the grinding space where the six peripheral nozzles rotatable around their vertical axes are located symmetrically. The grinding chamber is also connected to the pregrinder by materials recirculating pipes in order to return the coarse fraction for pregrinding. The inner sizer is designed to be symmetrical with the axis of the grinding space, said sizer consisting of a surface area of a hyperboloid of revolution and an adjustable curb of blades having the same axis as the discharge stub for the ground product.

The other potential alternative design of the air-jet mill according to the invention differs from the one outlined above in the mode of construction of the pregrinding chamber. The pregrinder has two confluent shooting nozzles set at an angle within the range of 150°–180° and another injecting nozzle placed in the axis of the blow-pipe. All three may be connected with a charging funnel each.

With either design of the air-jet mill, the material to be ground flows in the required quantity by gravity from the storage container onto the charging dish/disc feeder, the latter being eccentrically shaken. A uniform stream of material is supplied from the disc feeder into the material charging funnels located along the edge of the dish.

BRIEF DESCRIPTION OF THE DRAWINGS

The invention is illustrated in a couple of embodiments in the drawings attached, where.

DESCRIPTION OF THE PREFERRED EMBODIMENTS

Figure 1:
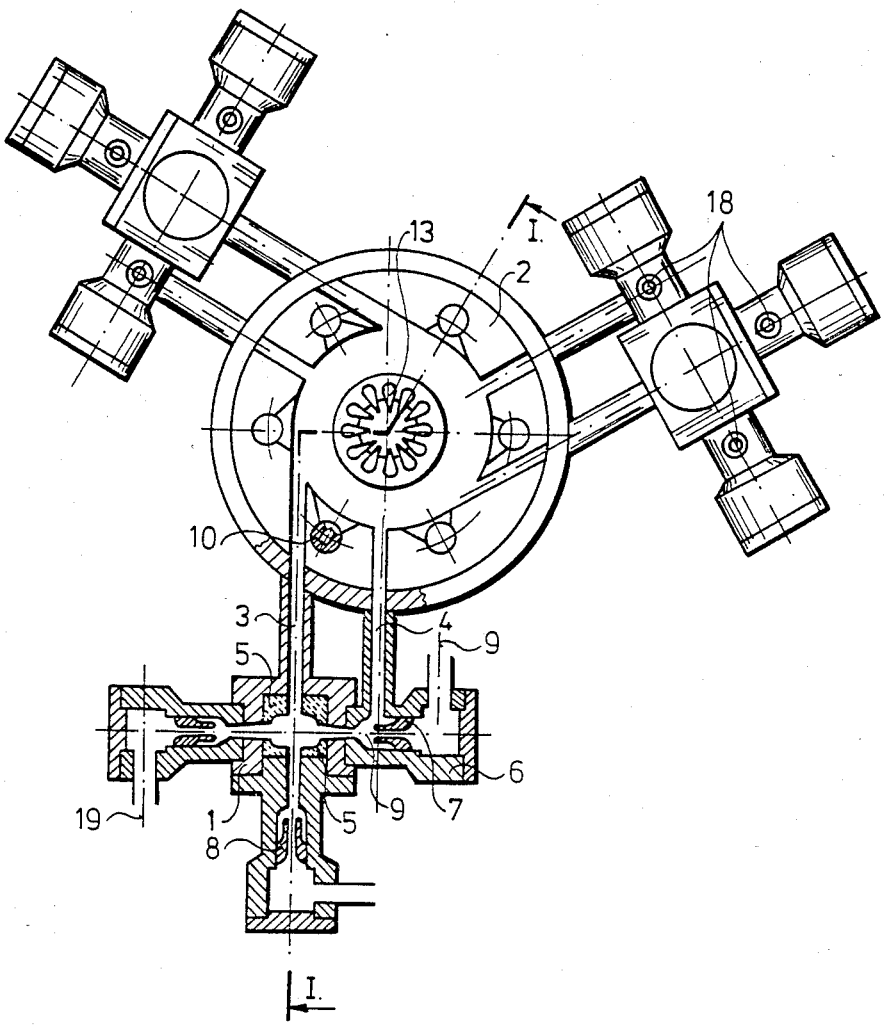
FIG. 1 shows the cross section of a possible construction of the invention.
Figure 2:
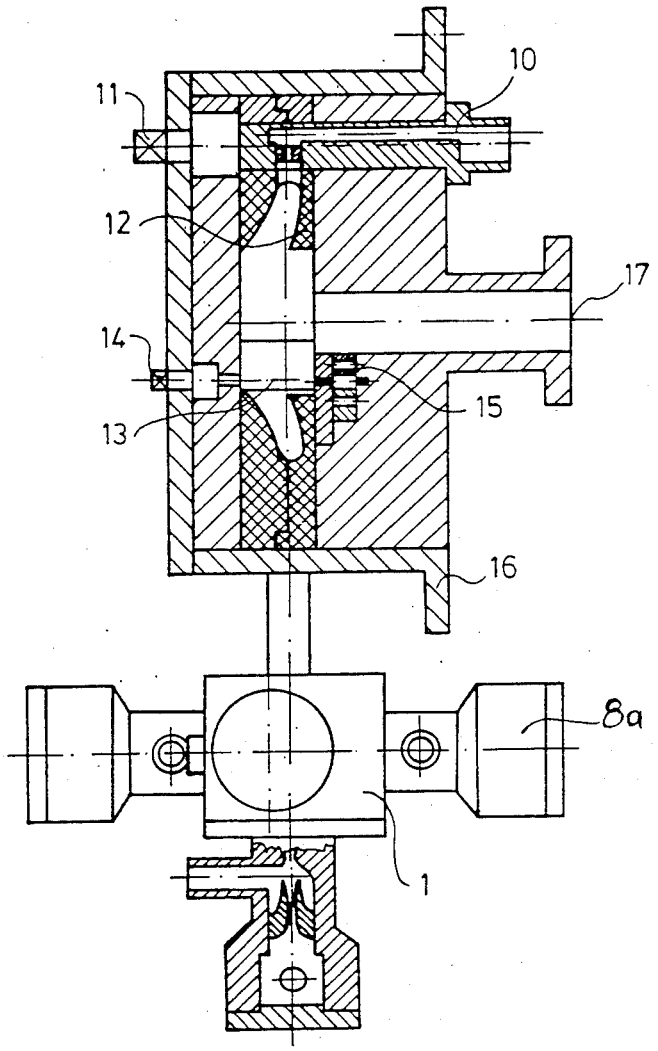
FIG. 2 shows a section taken along the line I—I indicated in FIG. 1.

In one possible embodiment shown as an example in FIGS. 1 and 2, three pregrinding chambers (1) are connected to the grinding space (2). The confluent nozzles (7) located in the nozzle casing (6) and the injecting nozzles (8) are linked to the pregrinding space (5) which is equipped with a wear resistant lining, by means of charging ducts (9) the latter being realized by Laval-profiles. There are also vertical auxiliary nozzles (8a) provided for injecting cooling medium of reagent for surface treatment of the particles. The pregrinder is connected with the grinding space via a blowing duct (3) and a material return duct (4). The peripheral grinding nozzles (10) are located symmetrically in the grinding space (2) and can be swivelled in the horizontal plane by turning the angle setter (11). In the grinding space (2) there is a wear resistant lining (12) and an adjustable curb of blades (13) with an associated gear rim (15) and a stub (14) for setting the angle of blades. The curb of blades is thus an adjustable sizer effecting control over the size of the product discharge. As it can be seen from the drawings, the discharge stub (17) is located in the axis of the casing (16) of the air-jet mill. Material charging stubs (18) and air inlet stubs (19) are also provided on the mill.

Figure 3:
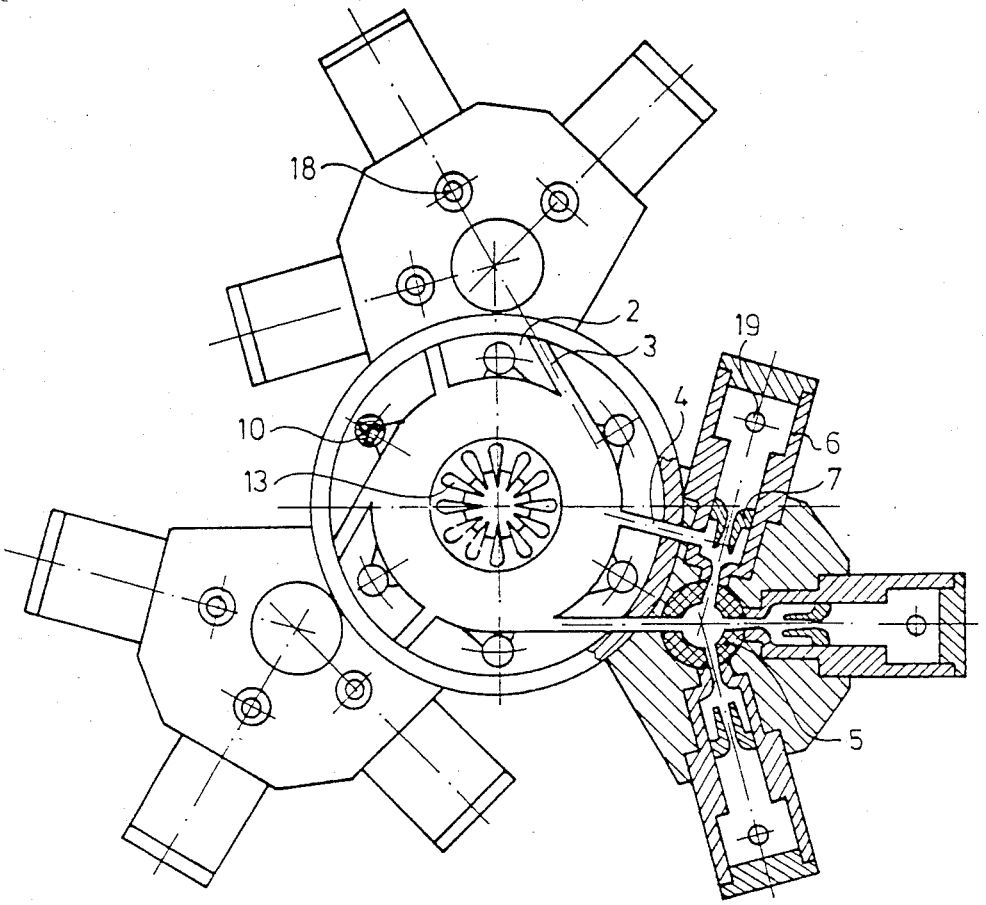
FIG. 3 shows a cross section of a second possible construction.
Figure 4:
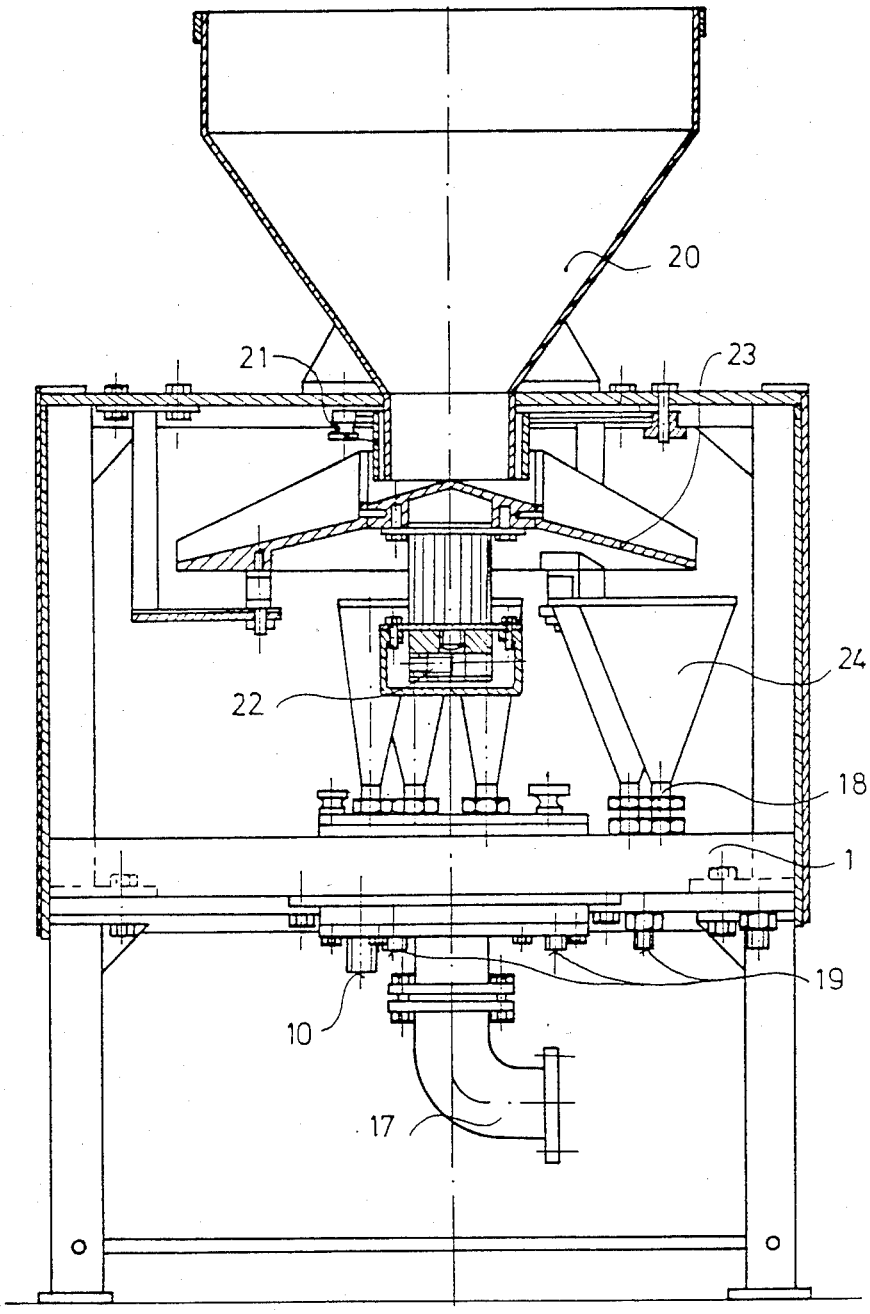
FIG. 4 shows a longitude section of the material charging system of the invention.

FIG. 3 shows another possible embodiment. In this case, the pregrinding chamber is of a simpler design; the axes of confluent nozzles (7) located in the nozzles casings (6) are set at 150°—180°, preferably 150° angles to each other. The angles to be set for the confluent nozzles should be selected as a function of the radius of the pregrinding space and in a way that is related to of the velocity of preground material pointing to the grinding space. The development of the grinding casing (2), the peripheral grinding nozzles (10) and the adjustable curb of blades (13) as well as charging of material is identical with those outlined above. Material charging system is described with reference to FIG. 4. The material storing hopper (20) is equipped with adjustable louvres (21). The material flows from the hopper onto disc feeder (23) which is shaken by an eccentrically operating unit (22) spreading the material uniformly and distributing the same into charging funnels (24) the latter being connected to the material supply stub (18).

The main advantage of the air-jet mill of the invention is that, in contrast to the mills known so far, the invention is capable of producing grain fractions less than 10 μm in size, capable of cryogenic grinding of thermoplastic materials and applying surface treating materials contemporarily with grinding. A further advantage of the facility lies in the excellent utilization of energy achieved through the novel shaping of the inner sizer (i.e., the adjustable curb of blades). The efficient utilization of the grinding energy, when as compared to a conventional device, is increased by up to fifty percent. Particular advantage lies in that the unit does not comprise any movable part which could be exposed to severe wear and the only one constructional part, the lining of the pregrinder which is exposed to the greatest wear can easily and be replaced at little expense.

We claim:

1. An air-jet mill for fine grinding and sizing, comprising at least one pregrinding chamber, a grinding chamber defining a circular-shaped grinding space connected by a tangential blow pipe oriented to introduce particulate material into said grinding space through an injecting nozzle in a direction tangential to the periphery of said grinding space at a point on said periphery and with an orientation which causes air flow in a first direction,peripheral grinding nozzles opening into the grinding space and a discharge stub for the ground material, a sizer positioned in the grinding chamber, said pregrinding chamber being connected with the grinding space by said tangential blow pipe and by a material return channel, said peripheral grinding nozzles opening into the grinding space arranged symmetrically along a circle and the number of said peripheral grinding nozzles being twice the number of injecting nozzles.

2. Air-jet mill according to claim 1, wherein said sizer comprises a curb of blades located in the grinding space and mounted in a replaceable fashion and wherein the angle of blades is adjustable during operation.

3. Air-jet mill according to claim 1 wherein three or more confluent nozzles and auxiliary nozzles are set preferably at 90°—180° angles to each other and each located in a nozzle casing and an injecting nozzle is located in the axis of the blow pipe, said confluent, auxiliary and injecting nozzles being connected to the pregrinding chamber and being adjustable, in the axial direction.

4. Air-jet mill according to claim 3, wherein horizontal nozzles of the pregrinding chamber are connected with a material supply stub, the auxiliary nozzles being connected to the storage tanks of the coolant and/or surface treating material, respectively.

5. Air-jet mill according to claim 1 wherein said peripheral grinding nozzles are replaceable and rotatable in the horizontal plane.

6. Air-jet mill according to claim 1, wherein the grinding space and the pregrinding space are provided with a very hard replaceable lining made preferably of sintered corundum or various carbides or glass-hard hardened steel.

7. Air-jet mill according to 1 wherein a connection with a material storing hopper is accomplished by adjustable louvres, a disc feeder shaken by an eccentrically operated unit, and further including charging funnels.

8. An Air-jet mill according to 1, wherein the grinding chamber has an interior surface shaped such that it rises along a circular arc on the bottom and exhibits a hyperboloid on the top.

9. An air-jet mill for fine grinding and sizing, comprising three pregrinding chambers, a grinding chamber defining a circular-shaped grinding space connected by tangential blow pipes, oriented to introduce particulate matter in a direction tangential to the periphery of said grinding space at a point on said periphery, peripheral grinding nozzles opening into the grinding space and a discharge stub for the ground material, a sizer positioned in the grinding chamber, said pregrinding chambers being connected with the grinding space by one each of said tangential blow pipes and by material return channels said peripheral grinding nozzles opening into the grinding space are arranged symmetrically along a circle.

10. An air-jet mill for fine grinding, surface treatment and/or cooled grinding, comprising:

(a) at least one pregrinding chamber;

(b) an annular grinding chamber connected by a flow passage to each pregrinding chamber;

(c) at least three injection nozzles communicating with the flow passage through each pregrinding chamber;

(d) peripheral grinding nozzles communicating with the grinding chamber, said peripheral grinding nozzles being arranged symmetrically;

(e) a discharge passage for the ground product extending axially from said grinding chamber;

(f) an inner sizer; and (g) a material return passage between the grinding chamber and each pregrinding chamber.

11. An air-jet mill according to claim 10, wherein each pregrinding chamber is connected to the grinding chamber by a plurality of flow passages extending tangentially to the grinding chamber.

12. An air-jet mill according to claim 10, wherein the pregrinding chamber is one of a plurality of pregrinding chambers each having an injection nozzle and the number of the peripheral nozzles is twice the number of the injection nozzles.

13. An air-jet mill according to claim 10, wherein an annular array of blades is disposed in the grinding chamber, said blades being replaceable, the grinding chamber having a surface shaped such that it rises along a circular arc on the bottom and exhibits a hyperboloid on the top.

14. An air-jet mill according to claim 10, wherein the pregrinding chamber is provided with three or more confluent nozzles located in a nozzle casing, a material injection nozzle being located in the axis of the flow passage.

15. An air-jet mill according to claim 14, wherein said confluent nozzles are set at an angle of 90°–180° to each other.

16. An air-jet mill according to claim 10, wherein each of said injection nozzles is adjustable axially thereof.

17. An air-jet mill according to claim 10, wherein the peripheral nozzles are replaceable and rotatable in a horizontal plane.

18. An air-jet mill according to claim 10, wherein the grinding chamber and the pregrinding space are each provided with a very hard replaceable lining.

19. An air-jet mill according to claim 18, wherein the linings are made of sintered corundum or various carbides or glass-hard hardened steel.

20. An air-jet mill according to claim 10, and including a material storing hopper connected to said mill by adjustable louvres, a disc feeder,a vibrator for vibrating the disc feeder and charging funnel means for funnelling the material from the disc feeder into the pregrinder chamber.

21. An air-jet mill according to claim 10, wherein the injection nozzles of the pregrinding chamber comprise horizontal nozzles connected with a material supply passage and vertical nozzles connected with storage chambers for coolant and/or surface treatment material.

* * * * *